US009920705B2

(12) United States Patent
Mosburger

(10) Patent No.: US 9,920,705 B2
(45) Date of Patent: Mar. 20, 2018

(54) FUEL INJECTION SYSTEM AND METHOD

(71) Applicants: Robert Bosch, LLC, Broadview, IL (US); Robert Bosch GmbH, Stuttgart (DE)

(72) Inventor: Michael Mosburger, Ann Arbor, MI (US)

(73) Assignees: Robert Bosch, LLC, Broadview, IL (US); Robert Bosch GmbH, Stuttgart (DE)

( * ) Notice: Subject to any disclaimer, the term of this patent is extended or adjusted under 35 U.S.C. 154(b) by 7 days.

(21) Appl. No.: 14/971,140

(22) Filed: Dec. 16, 2015

(65) Prior Publication Data

US 2017/0175664 A1 Jun. 22, 2017

(51) Int. Cl.

| | |
|---|---|
| ***F02D 41/30*** | (2006.01) |
| ***F02D 41/04*** | (2006.01) |
| ***F02D 41/26*** | (2006.01) |

(52) U.S. Cl.

CPC ..... *F02D 41/3017* (2013.01); *F02D 41/04* (2013.01); *F02D 41/26* (2013.01)

(58) Field of Classification Search

CPC ..... F02D 41/3017; F02D 41/26; F02D 41/04
See application file for complete search history.

(56) References Cited

U.S. PATENT DOCUMENTS

| | | | | |
|---|---|---|---|---|
| 4,454,847 | A * | 6/1984 | Isomura | F02D 41/263 123/480 |
| 6,988,485 | B2 | 1/2006 | Ichise et al. | |
| 7,216,627 | B2 | 5/2007 | Ito et al. | |
| 7,957,888 | B2 | 6/2011 | Leone et al. | |
| 8,601,863 | B2 | 12/2013 | Nishigaki et al. | |
| 8,973,556 | B2 | 3/2015 | Hoefner et al. | |
| 8,989,989 | B2 | 3/2015 | Sczomak et al. | |
| 9,435,287 | B2 * | 9/2016 | Surnilla | F02D 41/008 |
| 9,441,570 | B2 * | 9/2016 | Cohn | F02D 13/0215 |
| 2006/0208108 | A1 | 9/2006 | Kato et al. | |
| 2009/0320454 | A1 | 12/2009 | Sawada et al. | |

(Continued)

FOREIGN PATENT DOCUMENTS

| | | |
|---|---|---|
| DE | 19546377 | 7/1996 |
| DE | 19853799 | 5/1998 |

(Continued)

OTHER PUBLICATIONS

German Office Action dated Aug. 17, 2017.

*Primary Examiner* — Joseph Dallo
*Assistant Examiner* — Kurt Liethen
(74) *Attorney, Agent, or Firm* — Kelly McGlashen; Maginot Moore & Beck LLP

(57) ABSTRACT

A combination port fuel injection (PFI) and direct injection (DI) dual path fuel injection system includes an electronic control unit (ECU) that switches between the PFI portion and the DI portion depending on the engine operating point and fuel flow requirements. During transitions in engine loading, the ECU instructs the PFI portion to increase injection for a limited amount of time, while instructing the DI portion to maintain a current injection. Subsequently, fueling is transitioned from the PFI portion back to the DI portion. Advantageously, the combination PFI and DI dual path fuel injection system mitigates the emission of particles during transient engine operating conditions.

20 Claims, 4 Drawing Sheets

(56) References Cited

U.S. PATENT DOCUMENTS

| | | | | |
|---|---|---|---|---|
| 2011/0162620 | A1* | 7/2011 | Bidner | F02D 41/0025 123/299 |
| 2014/0074381 | A1* | 3/2014 | Sczomak | F02D 41/1454 701/105 |
| 2014/0290597 | A1* | 10/2014 | Rumpsa | F02M 63/0265 123/41.02 |
| 2015/0330290 | A1* | 11/2015 | Glugla | F02D 19/0689 123/298 |
| 2016/0169145 | A1* | 6/2016 | Surnilla | F02D 41/345 701/104 |
| 2016/0377019 | A1* | 12/2016 | Russ | F02D 41/3094 123/486 |

FOREIGN PATENT DOCUMENTS

| | | | |
|---|---|---|---|
| DE | 10332635 | | 2/2005 |
| DE | 102008046715 | | 4/2009 |
| DE | 102010037003 | | 2/2012 |
| DE | 102013210604 | A1 | 12/2014 |
| JP | H03-54366 | | 3/1991 |
| JP | 2013253556 | A | 12/2013 |
| JP | 2013253557 | A | 12/2013 |
| WO | 2001/38709 | | 5/2001 |
| WO | 2014/068378 | | 5/2014 |
| WO | 2014/089304 | | 6/2014 |

* cited by examiner

FUEL INJECTION SYSTEM AND METHOD

BACKGROUND

1. Field of the Invention

The present invention relates to a fuel injection system for mitigation of particle emissions from a vehicle during transient operating conditions, and more particularly to system and method for controlling fuel injection using a dual path fuel injection system that includes both port fuel injection and direct fuel injection.

2. Description of the Related Art

Fuel may be delivered to gasoline fuel internal combustion engines using a direct injection (DI) fuel system, a port fuel injection (PFI) fuel system, or a combination of these two systems. The combination of DI and PFI is referred to as a dual path fuel injection system. DI systems are widely known in the automotive industry for their particular advantages in high load. fuel efficiency. PFI systems are widely known for having low noise, vibration and harshness (NVH) at low load operating points, good fuel economy at low load operating points, and cost.

The emission of particulates from gasoline fuel internal combustion engines has become the focus of combustion development, due to more stringent legislation on the emissions of particle mass and particle number in Europe, North America, and China. A main source for the formation of particles in some engines with a DI portion 22 is the impingement of liquid fuel on the piston top. If the fuel does not evaporate rapidly enough, the fuel film will lead to a diffusion flame, that has been identified as a major source of soot (i.e. particle) formation. At a change in operation to a high load engine operation, the long injection duration leads to increased spray penetration, liquid fuel can impinge on the piston. If the engine stays at the high-load operating point for at least several seconds, the piston temperature will eventually rise high enough and the fuel that was deposited on the piston will evaporate before the main combustion event.

However, as the engine transitions from a low load point to a higher load operating point, the piston temperature will still be relatively cool and requires several seconds to heat up. Fuel that impinges on the piston immediately after the load step may not completely evaporate, and lead to diffusion flames on the piston top, also known as pool fires, forming and emitting large amount of particles.

Improved fuel injecting strategies are required to mitigate the emission of particles in transient engine operating conditions.

SUMMARY

In some aspects, a fuel injection system is configured to provide fuel to an engine. The fuel injection system includes a first device that monitors a load of the engine, and outputs a signal corresponding to the load of the engine, a direct fuel injector disposed in a cylinder of the engine and a port fuel injector disposed in an intake pipe of the cylinder. In addition, the fuel injection system includes a controller that is configured to receive output from the first device, and based on the device output, determine when a load of the engine has increased, and when a load of the engine has increased, control the port fuel injector to increase the amount of fuel being injected.

The fuel injection system may include one or more of the following features: The controller is configured to decrease the amount of fuel being injected at a time subsequent to a time of controlling the port fuel injector to increase the amount of fuel being injected. When the received output from the first device indicates an increased engine load, the controller initially controls the direct fuel injector to continue without changing the amount of fuel injected, and subsequently controls the direct fuel injector to increase the amount of fuel being injected. The fuel injection system further includes a second device that determines a temperature of a portion of the engine, and outputs a signal corresponding to the temperature of the portion of the engine. When a load of the engine has increased, the controller is configured to initially control the port fuel injector to increase the amount of fuel being injected, and when the signal corresponding to temperature of a portion of the engine corresponds to temperature greater than a predetermined temperature, the controller is configured to decrease the amount of fuel being injected by the port fuel injector. The second device includes a second sensor that is configured to detect a temperature of the portion of the engine. The second device is configured to model a temperature of the portion of the engine based on sensor input and a history of recent operating conditions undergone by the engine. The first device includes a first sensor that is configured to detect the load of the engine. Output from the first device reflects an output from the first sensor in combination with recent engine operation information. The first device is an engine speed sensor.

In some aspects, a fuel injection control device includes a device that monitors a load of the engine, and outputs a signal corresponding to the load of the engine, a direct fuel injector configured to be disposed in a cylinder of the engine and a port fuel injector configured to be disposed in an intake pipe of the cylinder. In addition, the fuel injection control device includes a controller that is configured to receive output from the device. When the received output from the device indicates an increased engine load, the controller initially controls the direct fuel injector to maintain without change the amount of fuel being injected by the direct fuel injector, and then following a time delay, to subsequently increase the amount of fuel being injected by the direct fuel injector.

The fuel injection device may include one or more of the following features: The controller maintains without change the amount of fuel being injected by the direct fuel injector until a temperature of a portion of the engine reaches a predetermined temperature, and then increases the amount of fuel being injected by the direct fuel injector. When the received output from the device indicates an increased engine load, the controller controls the port fuel injector to increase the amount of fuel being injected by the port fuel injector, and then to subsequently decrease the amount of fuel being injected by the port fuel injector.

In some aspects, a method of controlling fuel injection to a cylinder of an engine includes using a first device to monitor engine load, and outputting a signal from the first device corresponding to the engine load, and determining whether the engine load has increased based on the signal from the first device. When it has been determined that, the engine load has increased, the method includes controlling a port fuel injector to increase the amount of fuel discharged by the port fuel injector and controlling a direct fuel injector to maintain without change the amount of fuel being discharged by the direct fuel injector. In addition, the method includes using a second device to monitor a temperature of a portion of the engine, and outputting a signal from the second device corresponding to the temperature of the portion of the engine. When the temperature of the portion of the engine is greater than a predetermined temperature, the method includes decreasing the amount of fuel discharged by the port fuel injector and increasing the amount of fuel discharged by the direct fuel injector.

The method may include one or more of the following method steps and/or features: When the temperature of the piston is greater than a predetermined temperature, linearly increasing the amount of fuel discharged by the direct fuel injector over time. When the temperature of the piston is greater than a predetermined temperature, linearly decreasing the amount of fuel discharged by the port fuel injector over time. The step of using a first device to monitor engine load comprises detecting a first engine load at a first time and detecting a second engine load at a second time that is subsequent to the first time, and the step of determining whether the engine load has increased is performed by calculating a difference between the first engine load and a second engine load. The first engine load and the second engine load are detected by an engine speed sensor. The first engine load and the second engine load are detected by throttle position sensor. The step of using a second device to monitor a temperature of a portion of the engine comprises using a temperature sensor to detect the temperature of the portion of the engine. Signal output by the second device is based on a model that determines a temperature of the portion of the engine based on sensor input and a history of recent operating conditions undergone by the engine.

A combination PFI and DI dual path fuel injection system operates by switching from one fuel system to another depending on the engine operating point and fuel flow requirements. During transitions in engine loading, for example transitions from a low engine load to a high engine load, an electronic control unit is used to at least partly engage the PFI portion of the system for a limited amount of time (on the order of seconds) as the engine undergoes the load change. By doing so, the injection duration and therefore spray penetration from the DI injector is reduced and therefore impingement of liquid fuel onto the piston is reduced. As the piston temperature slowly increases after the engine load change, fueling is transitioned from the PFI portion of the system to the DI portion of the system. Advantageously, the combination PFI and DI dual path fuel injection system mitigates the emission of particles in transient engine operating conditions.

In one exemplary embodiment, in situations where the engine transitions from a low load operating point to a higher load operating point, fueling at the tower load operating point is provided from the PFI portion, and the DI portion may be engaged either with delay or with slowly increasing rate of injection, or both. In this embodiment, the PFI portion is mainly used to supply the increased amount of fuel to undergo the load switch.

In another exemplary embodiment, in situations where the engine transitions from a low load operating point to a higher load operating point white fueling was already being provided from the DI portion at the lower load point, fueling at the lower load operating point is provided from the DI portion, and the fuel flow from DI portion would be increased either with delay or with slowly increasing rate of injection, or both. In this embodiment, the PFI portion is used to temporarily supply the increased amount of fuel required during the load change.

The combination PFI and DI dual path fuel injection system described herein can be compared to some conventional combination PFI and DI dual path fuel injection systems, in which fueling is typically commanded from the PFI portion at low load engine operation, whereas the DI portion is only used for higher load operating points. In situations where the engine transitions from a low load (PFI fueled) to a higher load operating point, fueling in some conventional dual path systems is typically switched from the PFI portion to the DI portion to take advantage of the fuel economy benefits of the DI portion at the higher load operating point (FIG. 6). If the fueling was already provided from the DI portion at the lower load point, the load step is entirely controlled by the DI portion with no engagement of the PFI portion (FIG. 7). In both cases, the engine in which fuel injection is controlled by the conventional dual path fuel injection system may suffer from high spray penetration with fuel impingement onto the cold piston, leading to diffusion flames and formation and emission of particles.

DETAILED DESCRIPTION

Figure 1:
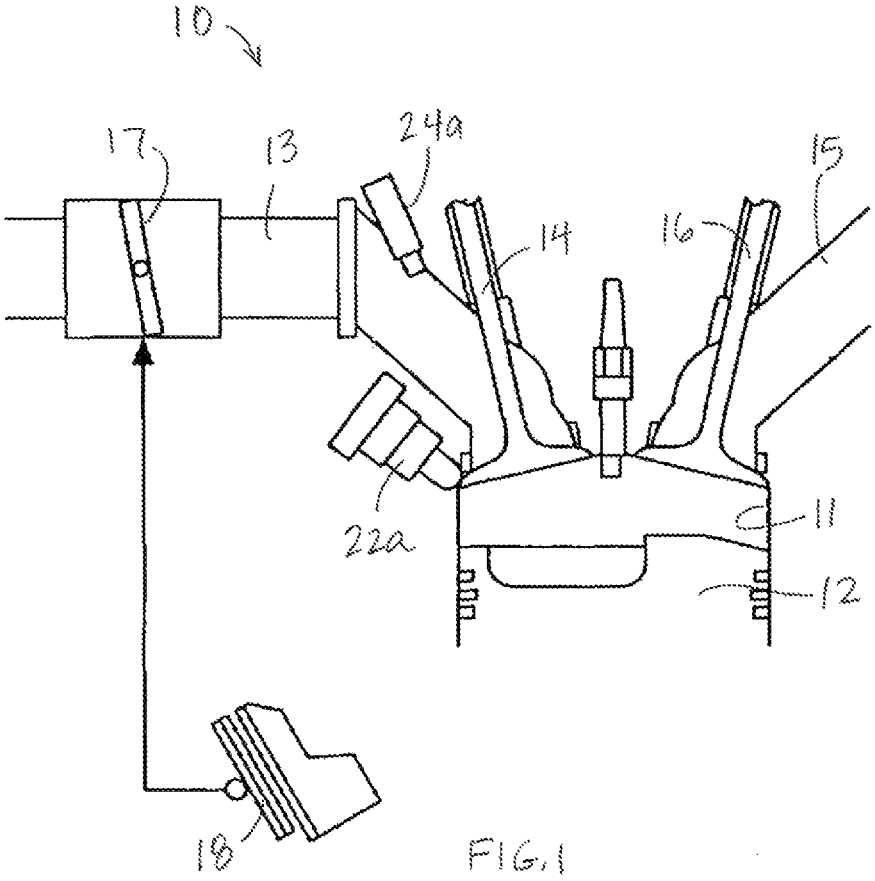
FIG. 1 is a schematic illustration of a portion of an internal combustion engine.
Figure 2:
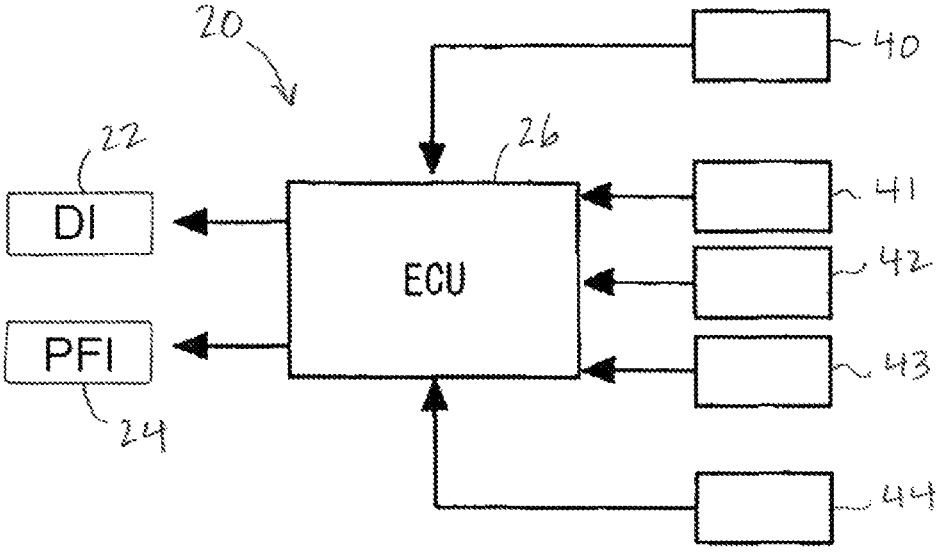
FIG. 2 is a schematic diagram illustrating the dual path fuel injection system.

Referring to FIGS. 1-2, an internal combustion engine 10 includes a cylinder 11 and a piston 12 that reciprocates within the cylinder 11. Air is delivered to the cylinder 11 via an intake valve 14 from air intake pipe 13. The air intake pipe 13 also includes a throttle valve 17 that is mechanically connected to an actuator pedal 18 operated by the vehicle driver. Exhaust gas is discharged from the cylinder 11 via an exhaust valve 16 to an exhaust gas outlet pipe 15. The internal combustion engine 10 also includes a dual path fuel injection system 20 that includes a DI portion 22 and a PFI portion 24. The D portion 22 and a PFI portion 24 each include an injector 22*a*, 24*a* for each cylinder of the engine. The DI fuel injector 22*a* extends into the cylinder 11 and is arranged to inject fuel directly onto the upper surface of the piston 12. The PFI fuel injector 24*a* extends into the air intake pipe 13 at a location upstream of the intake valve 14, and is arranged to direct fuel toward the air intake valve 14. The dual path fuel injection system 20 also includes an electronic control unit (ECU) 26 that controls the DI portion 22 and the PFI portion 24. During transitions in engine loading, for example transitions from a low engine load to a high engine load, the ECU 26 controls the DI portion 22 and the PFI portion 24 in a strategic manner that results in reduced or eliminated particle emissions, as discussed further below.

In particular, the ECU 26 controls the DI portion 22 and the PFI portion 24 based on engine load and piston temperature conditions. Detection of the engine load L can be accomplished, for example, by monitoring a sensor that detects engine speed. In the illustrated embodiment, the fuel injection system 20 includes an engine speed sensor 40 that detects the speed of the engine crankshaft, and is used to monitor engine load L. However, the engine load L can also be detected by monitoring the throttle valve position via a throttle valve position sensor 41, the accelerator pedal position via a pedal position sensor 42, the exhaust pressure via a pressure sensor 43 disposed in the outlet pipe 15 or other system property, and the dual path fuel injection system 20 can use one or more of these sensors or other appropriate sensors alone or in combination to monitor engine load L.

The piston temperature $t_p$ may be monitored directly via a temperature sensor 44 disposed in an appropriate location, or may be calculated based on known models used for this purpose. In some embodiments, the model-based approach may use input from sensors such as those used to monitor engine operating conditions (engine speed, engine load, air intake temperature, engine coolant temperature, air/fuel ratio, spark timing, etc.) as well as incorporating information related to recent (e.g., historical) operating conditions to calculate a piston temperature $t_p$. For example, following a period of engine idling, the model may calculate a low piston temperature $t_p$, whereas following a period of driving at highway speeds, the model may calculate a relatively high piston temperature $t_p$.

Figure 3:
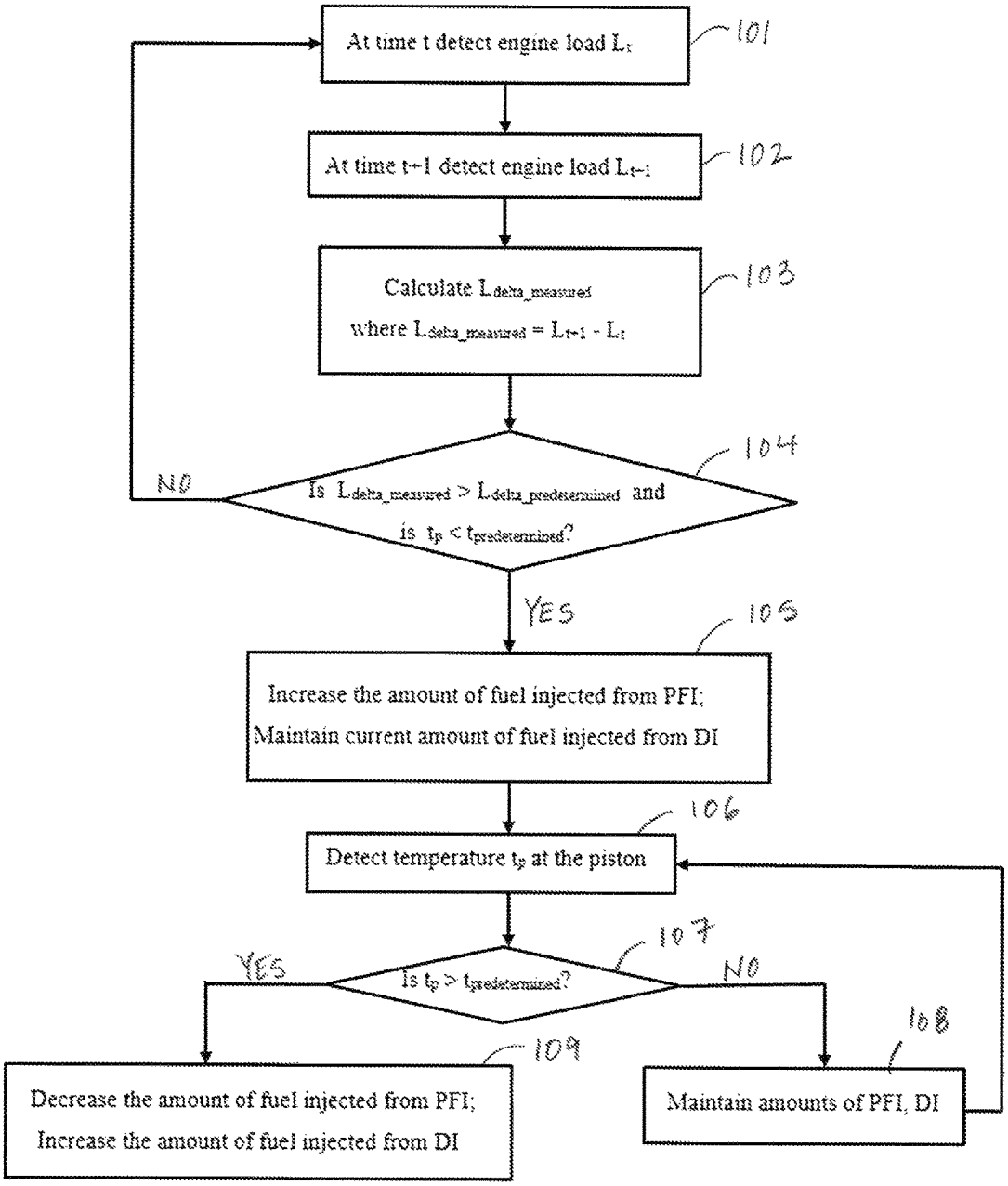
FIG. 3 is a flow diagram illustrating a method of controlling the dual path fuel injection.

Referring to FIG. 3, the ECU 26 is configured to monitor engine load L and piston temperature $t_p$, and to implement a fuel injection control method during transient loading conditions that reduces particle emissions from the cylinder. The fuel injection control method includes periodically measuring the engine load L, and determining if there is a change in the engine load L. In particular, the method includes measuring the engine load $L_t$ at a time t (step 101), measuring the engine load $L_{t+1}$ again at a subsequent time $t_{t+1}$ (step 102), and then comparing the measured loads $L_t$ and $L_{t+1}$ to determine whether a load change has occurred (step 103). For example, the ECU 26 may determine a load change $L_{delta_measured}$ by performing the calculation ($L_{delta_measured}=L_{t+1}-L_t$).

Following calculation of $L_{delta_measured}$, the measured load change $L_{delta_measured}$ is compared to a predetermined load change $L_{delta_predetermined}$ to determine whether the change in load is sufficient to require implementation of the transient load fuel injection control method (step 104). The predetermined load change $L_{delta_predetermined}$ is set to be greater than transient changes in detected load. In addition, the predetermined load change $L_{delta_predetermined}$ is set to correspond to a load change that is sufficiently large to correspond to a fuel injection increase that would generate increased particle emissions in a conventional fuel injection system (e.g., when the piston 12 is relatively cold for the amount of fuel being injected). In some embodiments, the predetermined load change $L_{delta_predetermined}$ may be a value calculated in real time based on recent driving history, current engine conditions, etc. In other embodiments, the predetermined load change $L_{delta_predetermined}$ may be a set value that is based on, for example, a theoretical optimum or previous data.

If the calculated load change $L_{delta_measured}$ is less than the predetermined load change $L_{delta_predetermined}$, the ECU 26 controls the PFI portion 24 and the DI portion 22 in such a way as to maintain the current injection amounts provided by each portion 22, 24, and engine load monitoring is continued.

If the calculated load change $L_{delta_measured}$ is greater than the predetermined load change $L_{delta_predetermined}$, and the temperature of the piston $t_p$ is greater than a predetermined temperature $t_{predetermined}$, no changes are made to the way in which the ECU 26 controls the PFI portion 24 and the DI portion 22, and monitoring of the engine load L is continued. The predetermined temperature $t_{predetermined}$ is set based on a temperature at which the piston 12 will evaporate the amount of fuel being injected before particle formation. Thus, $t_{predetermined}$ may vary depending on the amount of fuel to be injected.

If the calculated load change $L_{delta_measured}$ is greater than the predetermined load change $L_{delta_predetermined}$, and the temperature of the piston $t_p$ is less than the predetermined temperature $t_{predetermined}$, the ECU 26 controls the PFI portion 24 and the DI portion 22 in such a way as to minimize or avoid particle formation. In particular, the ECU 26 instructs the PFI portion 24 to increase the amount of fuel injected. The increase in the amount of fuel injected from the PFI portion 24 may be a step-wise or nearly step-wise increase, and is sufficient to provide the fuel required to address the change in engine load $L_{delta_measured}$.

In addition to increasing the amount of fuel provided by the PFI portion 24, the ECU 26 also instructs the DI portion 22 to maintain the current amount of fuel injected from each DI fuel injector 22*a*. The current amount of fuel injected from each DI fuel injector 22*a* will depend on the operating conditions at the time of the engine load change. For example, in operating conditions where the DI portion 22 had been injecting no fuel, such as typically occurs during low engine loads, the DI portion 22 will continue to inject no fuel. In operating conditions where the DI portion 22 had been injecting some fuel, the DI portion 22 will continue to inject the same amount of fuel. Thus, the ECU 26 controls the PFI portion 24 and DI portion 22 in such a way that the increase in fuel requirements due to the measured load change are met by increasing the PFI fuel injection amount rather than increasing the DI fuel injection amount. As a result, the situation in which an increased amount of fuel is directly applied to the top of the relatively cool piston is avoided.

The PFI portion 24 continues to provide the increased amount of fuel and the ECU continues to periodically monitor engine load L and piston temperature $t_p$ as long as the piston temperature $t_p$ is less than that of the predetermined temperature $t_{predetermined}$ (step 106, step 108). However, due to increased engine output corresponding to increased fuel amounts provided by the PFI portion 24, the piston 12 is gradually heated. When the ECU 26 determines that the temperature detected at the piston $t_p$ is greater than the predetermined temperature $t_{predetermined}$ (step 107), the piston 12 is sufficiently hot to quickly evaporate additional fuel applied to the top of the piston by the DI portion 22. For this reason, and because DI fuel injection provides fuel efficiency at high engine loads, the ECU 26 then instructs the DI portion 22 to increase the amount of fuel injected (step 109). In the illustrated example, the amount of fuel injected by the DI portion 22 is linearly increased. At the same, time, the ECU 26 instructs the PFI portion 24 to decrease the amount of fuel injected. In the illustrated example, the amount of fuel injected by the PFI portion 24 is linearly decreased. In particular, the amounts of fuel injected by the DI portion 22 and the PFI portion 24 are balanced, e.g., the sum of the amounts of fuel provided by each portion 22, 24 is set equal to the fuel requirements of the engine.

In embodiments in which the load change occurs while the DI portion 22 is not being operated, the fuel injection method initially maintains the DI portion 22 in an off condition. After a time delay until the piston temperature has sufficiently increased, the fuel injection from the DI portion 22 is turned on and increased (for example, gradually and/or linearly increased) while the fuel injection from the PFI portion 24 is decreased (for example, gradually and/or linearly decreased). In the embodiment illustrated in FIG. 4, no fuel is being injected from the DI portion 22 at the time of the engine load change, for example, at time t=1. Thus, the DI portion 22 remains off until a later time at which the piston temperature $t_p$ is greater than the predetermined piston temperature $t_{predetermined}$, for example, at time t=2. During the time period between time t=1 and time t=2, the fuel requirements for the increased engine load are met by an increase in injection amount from the PFI portion 24. After the time t=2, the DI fuel injection is linearly phased in while the PFI fuel injection is linearly phased out. In particular, the DI fuel injection increases until all fuel requirements are met by the DI portion 22, and the PFI portion 24 can be turned off.

In embodiments in which the load change occurs while the DI portion 22 is being operated, the fuel injection method initially maintains the amount of fuel injected by the DI portion 22 without change, and when the piston temperature has sufficiently increased, the fuel injection from the DI portion 22 is (for example, gradually and/or linearly) increased while the fuel injection from the PFI portion 24 is (for example, gradually and/or linearly) decreased. In the embodiment illustrated in FIG. 5, fuel is being injected from the DI portion 22 at the time of the engine load change, for example, at time t=1. Thus, the DI portion 22 continues to provide a constant level of fuel injection until a later time at which the piston temperature $t_p$ is greater than the predetermined piston temperature $t_{predetermined}$, for example, at t=2. During the time period between time t=1 and time t=2, the fuel requirements for the increased engine load are met by an increase in injection amount from the PFI portion 24. After the time t=2, the DI fuel injection is linearly increased while the PFI fuel injection is linearly decreased. In particular, the DI fuel injection increases until all fuel requirements are met by the DI portion 22, and the PFI portion 24 can be turned off.

Figure 4:
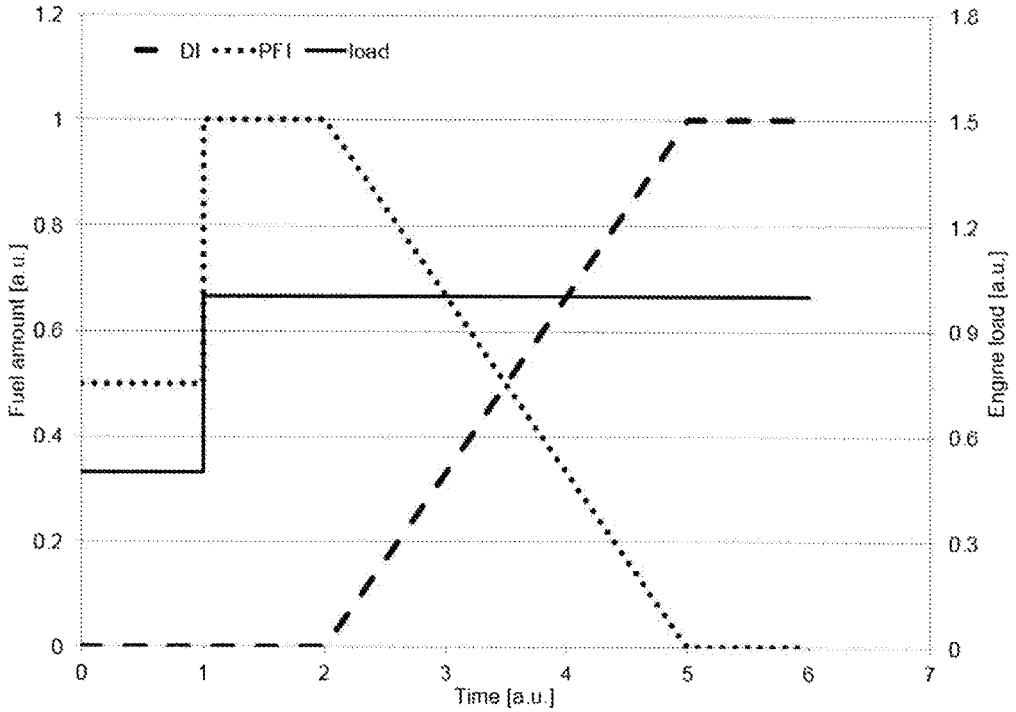
FIG. 4 is a graph illustrating fuel amount and engine load versus time for one operating scenario.
Figure 5:
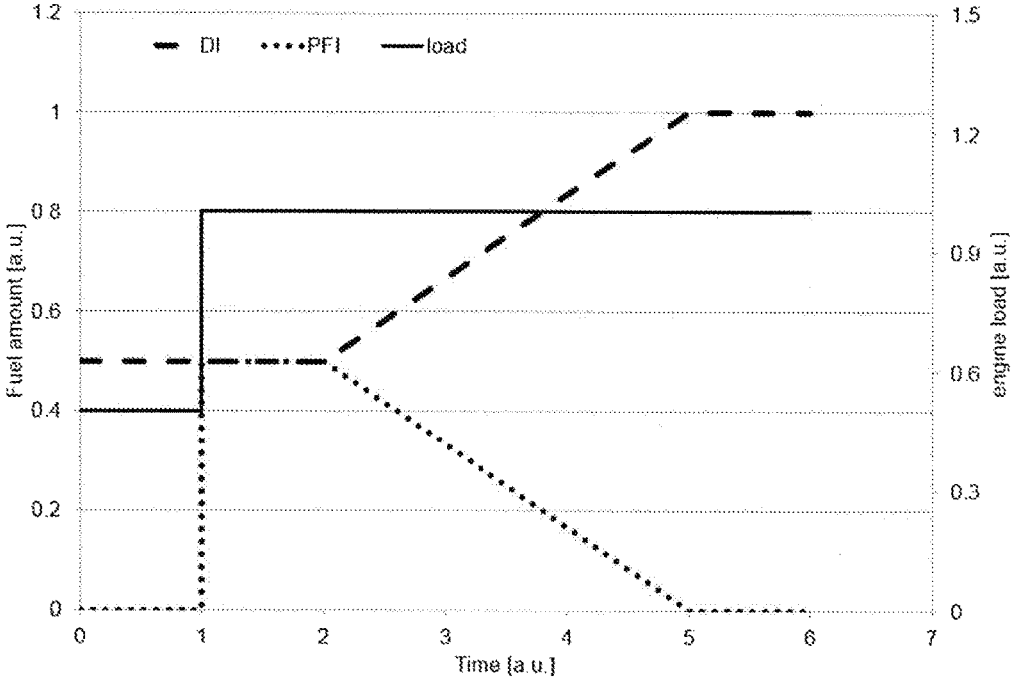
FIG. 5 is a graph illustrating fuel amount and engine load versus time for another operating scenario.
Figure 6:
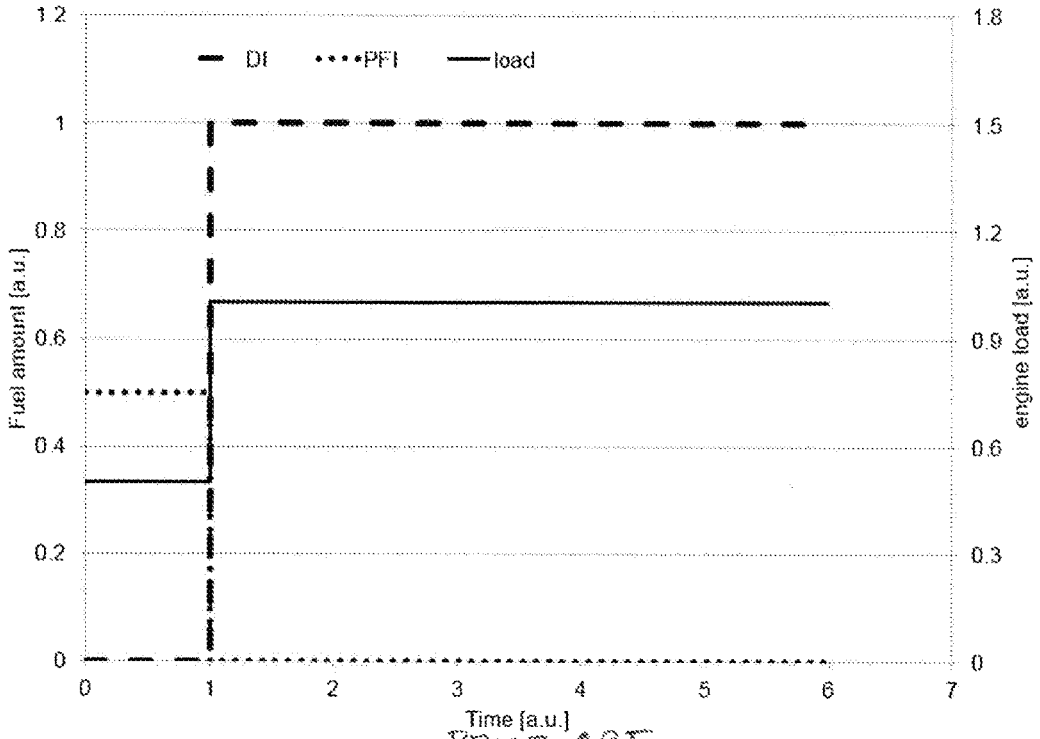
PRIOR ART FIG. 6
FIG. 6 is a graph illustrating fuel amount and engine load versus time for a conventional fuel injection system for the operating scenario of FIG. 4.
Figure 7:
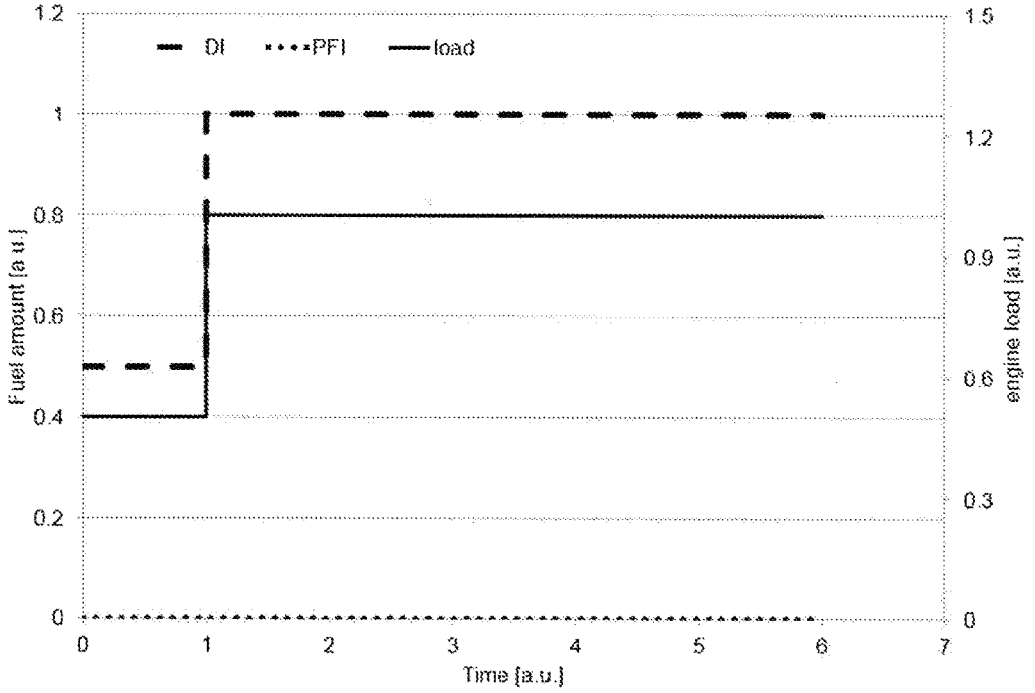
PRIOR ART FIG. 7
FIG. 7 is a graph illustrating fuel amount and engine load versus time for a conventional fuel injection system for the operating scenario of FIG. 5.

The plots provided in FIGS. 4-7 illustrate the relationship of fuel amount (left ordinate) and engine load (right ordinate) versus time (abscissa) for a dual path fuel injection system during transient load conditions. FIGS. 4 and 5 illustrate the relationship for two exemplary embodiments in which the fuel injection method illustrated in FIG. 3 is applied, and FIGS. 6 and 7 illustrate the relationship in accordance with some conventional dual path fuel injection systems operating in corresponding conditions. In the plots, the units for fuel amount, engine load and time are provided in arbitrary units (a.u.), and thus show relative relationships. Actual units will depend on the specific application. For example, the units for fuel amount may be in terms of volume such as milliliter or microliter, or alternatively may be in terms of injection frequency. The units for engine load will depend on the type of sensor(s) used to detect the engine load, and for example may be in terms of rpm corresponding to detection of engine speed or in terms of angular degrees corresponding to detection of throttle angle or actuator angle, etc. As regards time, the ECU 26 provides the above-described fuel injection control paradigm over a time frame that lasts on the order of seconds, corresponding to the time frame that begins when a load change is detected, includes actuation of the PFI portion 24 and ends when the DI portion 22 solely provides fuel injection. Thus, the units for time will be in seconds or fractions of seconds.

The dual path fuel injection system and method described above with respect to FIGS. 1-3 can be compared to some conventional dual path fuel injection systems use the PFI injectors during low load operating conditions, and switch to DI at times of increasing engine load. By switching to only DI, relatively large amounts of fuel are injected onto a relatively cool piston 12, whereby particle formation may occur.

In the illustrated embodiment, the determination of a change in load is made based on a change in the output of the engine speed sensor 40 or other relevant sensor. However, the method is not limited to this configuration. For example, in some embodiments, the determination of a triggering change in load is made based on a change in the output of the sensor in combination with information about recent operating history. For example, a relatively smaller engine load increase following a cold start or extended period of idling may be sufficient to initiate the method described herein, whereas a relatively larger engine load increase would be required to initiate the method described herein following a period of high speed travel in which the piston temperature is already relatively high. This approach is particularly useful when the piston temperature $t_p$ is obtained from direct measurement rather than from a model.

In the embodiments illustrated in FIGS. 4 and 5, following a determination that the piston temperature $t_p$ is greater than a predetermined temperature $t_{predetermined}$, the PFI fuel injection amount is linearly decreased as the DI fuel injection amount is linearly increased. However, the change in PFI and DI fuel injection is not limited to a linear change. For example, the change may be nonlinear, exponential, step-wise (single step or multiple steps), etc., or a combination thereof. Moreover, although the relationship between the PFI and DI fuel injection amounts need not mirror each other, the sum of the amounts provided by the PFI and DI portions 22, 24 be a constant over time, and should meet the requirements of the applied load.

Although the fuel injection method described herein compares the measured load change $L_{delta_measured}$ to a predetermined load change $L_{delta_predetermined}$, and piston temperature $t_p$ to a predetermined temperature $t_{predetermined}$ to initiate the dual path fuel injection method, the method is not limited to this arrangement. For example, in other embodiments, the method does not include use of piston temperature $t_p$, and changes in the amounts of DI and PFI injection are set to occur at a predetermined time. That is, it may be assumed that the piston temperature $t_p$ will be sufficient at the predetermined time, which may correspond to a predetermined delay following the load increase.

Although the temperature measurements used in the method are described with respect to the temperature of the piston 12, the method is not limited to using the piston temperature $t_p$. For example, in some embodiments, the method may replace the piston temperature $t_p$ with the temperature at an alternative location, such as a temperature of the cylinder or of the engine block in the vicinity of the cylinder, a temperature of the exhaust gas or the temperature at a combination of locations.

The devices and methods described herein may be implemented by one or more computer programs executed by one or more processors. The computer programs include processor-executable instructions that are stored on a non-transitory tangible computer readable medium. The computer programs may also include stored data or the ability to access stored data. Non-limiting examples of non-transitory tangible computer readable medium are non-volatile memory, magnetic storage and optical storage.

Selective illustrative embodiments of the dual path fuel injection system and method including the PFI portion and the DI portion are described above in some detail. It should be understood that only structures considered necessary for clarifying these devices and the method have been described herein. Other conventional structures, and those of ancillary and auxiliary components of the fuel injection system, are assumed to be known and understood by those skilled in the art. Moreover, while working examples of the fuel injection system and method have been described above, the fuel injection system and method are not limited to the working examples described above, but various design alterations may be carried out without departing from the devices as set forth in the claims.

What is claimed is:

1. A fuel injection system configured to provide fuel to an engine, the fuel injection system including a first device that monitors a load of the engine, and outputs a signal corresponding to the load of the engine, a second device that determines a temperature of a portion of the engine, and outputs a signal corresponding to the temperature of the portion of the engine, a direct fuel injector disposed in a cylinder of the engine, a port fuel injector disposed in an intake pipe of the cylinder, and a controller that is configured to receive output from the first device, and based on the output of the first device, determine whether a load of the engine has changed by an amount that is greater than a predetermined load change amount, and receive output from the second device, and based on the output of the second device, compare a temperature of a portion of the engine to a predetermined temperature, and when the load of the engine has increased, control the port fuel injector to increase the amount of fuel being injected changed by an amount that is greater than a predetermined load change amount and the temperature of a portion of the engine is less than a predetermined temperature, the controller is configured to increase the amount of fuel being injected by the port fuel injector, and when the load of the engine has changed by an amount that is greater than a predetermined load change amount and the temperature of a portion of the engine is greater than the predetermined temperature, the controller is configured to maintain without change the amount of fuel being injected by the port fuel injector and the direct injector.

2. The fuel injection system of claim 1, wherein the controller is configured to decrease the amount of fuel being injected at a time subsequent to a time of controlling the port fuel injector to increase the amount of fuel being injected.

3. The fuel injection system of claim 1, wherein when the received, output from the first device indicates an increased engine load, the controller initially controls the direct fuel injector to continue without changing the amount of fuel injected, and subsequently controls the direct fuel injector to increase the amount of fuel being injected.

4. The fuel injection system of claim 1, wherein subsequent to controlling the port fuel injector to increase the amount of fuel being injected, and when an updated signal corresponding to temperature of a portion of the engine corresponds to temperature greater than the predetermined temperature, the controller is configured to decrease the amount of fuel being injected by the port fuel injector.

5. The fuel injection system of claim 1, wherein the second device includes a second sensor that is configured to detect a temperature of the portion of the engine.

6. The fuel injection system of claim 1, wherein the second device is configured to model a temperature of the portion of the engine based on sensor input and a history of recent operating conditions undergone by the engine.

7. The fuel injection system of claim 1, wherein the first device includes a first sensor that is configured to detect the load of the engine.

8. The fuel injection system of claim 7, wherein output from the first device reflects an output from the first sensor in combination with recent engine operation information.

9. The fuel injection system of claim 1, wherein the first device includes an engine speed sensor.

10. A fuel injection control device including a device that monitors a load of the engine, and outputs a signal corresponding to the load of the engine, a direct fuel injector configured to be disposed in a cylinder of the engine, a port fuel injector configured to be disposed in an intake pipe of the cylinder, and a controller that is configured, to receive output from the device, and when the received output from the device indicates an increased engine load, the controller initially controls the direct fuel injector to maintain without change the amount of fuel being injected by the direct fuel injector, and then following a time delay, to subsequently increase the amount of fuel being injected by the direct fuel injector.

11. The fuel injection control device of claim 10, wherein the controller maintains without change the amount of fuel being injected by the direct fuel injector until a temperature of a portion of the engine reaches a predetermined temperature, and then increases the amount of fuel being injected by the direct fuel injector.

12. The fuel injection control device of claim 10, wherein when the received output from the device indicates an increased engine load, the controller controls the port fuel injector to increase the amount of fuel being injected by the port fuel injector, and then to subsequently decrease the amount of fuel being injected by the port fuel injector.

13. A method of controlling fuel injection to a cylinder of an engine includes using a first device to monitor engine load, and outputting a signal from the first device corresponding to the engine load, determining whether the engine load has increased based on the signal from the first device, when it has been determined that the engine load has increased, controlling a port fuel injector associated with a piston to increase the amount of fuel discharged by the port fuel injector and controlling a direct fuel injector associated with the piston to maintain without change the amount of fuel being discharged by the direct fuel injector, using a second device to monitor a temperature of a portion of the engine, and outputting a signal from the second device corresponding to the temperature of the portion of the engine;

when the temperature of the portion of the engine is greater than a predetermined temperature, decreasing the amount of fuel discharged by the port fuel injector and increasing the amount of fuel discharged by the direct fuel injector.

14. The method of claim 13, wherein when the temperature of the piston is greater than a predetermined temperature, linearly increasing the amount of fuel discharged by the direct fuel injector over time.

15. The method of claim 13, wherein when the temperature of the piston is greater than a predetermined temperature, linearly decreasing the amount of fuel discharged by the port fuel injector over time.

16. The method of claim 13, wherein the step of using a first device to monitor engine load comprises detecting a first engine load at a first time and detecting a second engine load at a second time that is subsequent to the first time, and the step of determining whether the engine load has increased is performed by calculating a difference between the first engine load and a second engine load.

17. The method of claim 16, wherein the first engine load and the second engine load are monitored by the first device which includes an engine speed sensor.

18. The method of claim 16, wherein the first engine load and the second engine load are monitored by the first device which includes a throttle position sensor.

19. The method of claim 13, wherein the step of using a second device to monitor a temperature of a portion of the engine comprises using a temperature sensor to detect the temperature of the portion of the engine.

20. The method of claim 13, wherein signal output by the second device is based on a model that determines a temperature of the portion of the engine based on sensor input and a history of recent operating conditions undergone by the engine.

* * * * *